US008365439B2

(12) United States Patent
Koh

(10) Patent No.: US 8,365,439 B2
(45) Date of Patent: Feb. 5, 2013

(54) SHOE HAVING DETACHABLE CUSHIONING MEMBER

(76) Inventor: Jong Taek Koh, Goyang (KR)

( * ) Notice: Subject to any disclaimer, the term of this patent is extended or adjusted under 35 U.S.C. 154(b) by 258 days.

(21) Appl. No.: 12/858,617

(22) Filed: Aug. 18, 2010

(65) Prior Publication Data

US 2011/0219645 A1 Sep. 15, 2011

(30) Foreign Application Priority Data

Mar. 15, 2010 (KR) ..... 10-2010-0022771
Apr. 19, 2010 (KR) ..... 10-2010-0035841

(51) Int. Cl.
*A43B 21/26* (2006.01)

(52) U.S. Cl. ..... 36/28; 36/35 R; 36/37; 36/15

(58) Field of Classification Search ..... 36/35 R, 36/37, 36 R, 42, 15, 28
See application file for complete search history.

(56) References Cited

U.S. PATENT DOCUMENTS

| | | | | |
|---|---|---|---|---|
| 3,182,409 | A * | 5/1965 | Herremans | 36/42 |
| 4,680,876 | A * | 7/1987 | Peng | 36/35 B |
| 6,751,891 | B2 * | 6/2004 | Lombardino | 36/28 |
| 7,055,264 | B2 * | 6/2006 | Gallegos | 36/3 B |
| 7,726,042 | B2 * | 6/2010 | Meschan | 36/27 |
| 2008/0034620 | A1 * | 2/2008 | Gallegos | 36/36 R |

* cited by examiner

*Primary Examiner* — Marie Patterson

(57) ABSTRACT

Disclosed is a shoe having a detachable cushioning member, in which the cushioning member for relieving an impact is detachable from a lower surface of a heel. More particularly, in the shoe having a detachable cushioning member, the cushioning member is selectively mounted to a lower surface of a heel of the shoe, a structure of the heel for mounting the cushioning member is simple so that it is possible to easily manufacture the shoe, and only the cushioning member has the construction for cushioning so that it is possible to easily replace and repair the cushioning member.

6 Claims, 7 Drawing Sheets

SHOE HAVING DETACHABLE CUSHIONING MEMBER

TECHNICAL FIELD

The present invention relates to a shoe having a detachable cushioning member, in which the cushioning member for relieving an impact is detachable from a lower surface of a heel. More particularly, the present invention relates to a shoe having a detachable cushioning member, in which the cushioning member is selectively mounted to a lower surface of a heel of the shoe, a structure of the heel for mounting the cushioning member is simple so that it is possible to easily manufacture the shoe, it is possible to easily change the cushioning degree of the cushioning member, and it is possible to easily repair the cushioning member.

BACKGROUND ART

In the conventional shoe having a cushioning member in an outsole, a cushioning member can reduce an impact applied to the ankle or knee during walking while wearing the shoe so that it is possible to protect the ankle or knee.

The conventional shoes having such a function are disclosed in Korean Utility Model Registration No. 20-0445353, Korean Utility Model Registration No. 20-0426095, Korean Patent Registration No. 10-0688389, Korean Patent Publication No. 10-2006-0069980, etc. According to the afore-mentioned conventional shoe, it can be noted that the conventional shoes provide the cushioning degree in various structures and schemes.

However, the conventional shoes have the structure in which the cushioning member is mounted to an internal side of an outsole of the shoe, so that it is difficult to manufacture the heel to which the cushioning member is mounted. Further, the mounting structure is complicated so that the process for mounting the cushioning member is difficult as well. Because of these difficulties, in order to mount the cushioning member, there is a burden in that the structure of the shoe should be modified and manufacturing equipment according to the modification should be additionally purchased.

Further, when a user desires to replace the cushioning member having the completed life-span due to the long-term use of the conventional shoes, the cushioning member is mounted to the internal side of the outsole so that it is impossible to separately replace only the cushioning member and thus the user should newly purchase the shoes in the end and spend the additional expense for the new shoes.

Further, there are the components that have been worn or have the reduced elastic force among the components constructing the cushioning member so that it is necessary to replace the corresponding components. However, in the conventional shoes according to the prior arts, it is difficult to replace the corresponding components.

In the meantime, weight is different for each individual and the desired cushioning degree according to the shock-absorbing is also different for each individual, so that it is preferable that the user selects the shoes that are appropriate for his/her weight and have the desired cushioning degree. However, in the conventional shoes, the cushioning member is embedded in the heel so that in order to provide the cushioning degree to satisfy every person, it is necessary to manufacture several shoes including the embedded cushioning member having the segmented cushioning degree and also manufacture the shoes according to their sizes. Therefore, a problem occurs in that the manufacturing expense of the manufacturer increases and the total stock increases. Because of the manufacturing expense, the manufacturer cannot manufacture the shoes having the various cushioning degree and thus there occurs a difficulty in that the customer cannot select the shock-absorbing shoes that are appropriate for his/her weight and have the desired cushioning degree.

DISCLOSURE

Technical Problem

Accordingly, the present invention has been made to solve the above-mentioned problems occurring in the prior art, and an object of the present invention is to provide a shoe having a detachable cushioning member, in which the cushioning member can be mounted through simply modifying the structure of the conventional shoe, the cushioning member is detachable so that it is possible to easily replace and repair the cushioning member, and it is possible to select and easily replace the components constructing the cushioning member so that the expense for repair can be reduced.

Further, another object of the present invention is to provide a shoe having a detachable cushioning member, in which the customer can easily change cushioning degree to the desired cushioning degree to be appropriate for his/her weight.

Technical Solution

In accordance with an aspect of the present invention, there is provided a shoe including a detachable cushioning member, in which the cushioning member is detachable from a heel 11 of the shoe, including: a seating recess 20 shaped like a depression and formed at a lower surface of the heel 11, the seating recess 20 including a first Velcro 21 attached to a surface facing an insole 13 among interior surfaces; and a cushioning member 100 fitted in the seating recess 20, of which a lower side protrudes from the heel 11.

According to an embodiment of the present invention, the cushioning member 100 including: an upper case 110 including a second Velcro 111 having a through hole 111*a* in an upper surface of the upper case 110, an internal guide pipe 112 and an external guide pipe 115 formed at an internal side and an external side of a lower surface of the upper case 110, respectively, and a latching protrusion 114 by which a diameter of a lower end of a hollow hole 113 is reduced, the hollow hole 113 of the internal guide pipe 112 being connected with a through hole 111*a* of the second Velcro 111; a lower case 120 shaped like a plate having a size appropriate for a size of a contour of the upper case 110, the lower case 120 including a support pipe 121 shaped like a pipe at an upper surface of a position that corresponds to a space between the internal guide pipe 112 and the external guide pipe 115 and a screw fastening part 122 having a protrusion shape and including a female screw, the screw fastening part 122 being positioned in an upper surface of a position that corresponds to the internal guide pipe 112; a spring 140 fitted around the internal guide pipe 112 and the screw fastening part 122 to elastically support a lower surface of the upper case 110 against an upper surface of the lower case 120; a cushioning piece 150 fitted between the internal guide pipe 112 and the external guide pipe 115 in a state in which the cushioning piece 150 is fitted around an upper part of the spring 140 to elastically support a lower surface of the upper case 110 against an upper surface of the support pipe 121; and a piston rod 130 fitted in the hollow hole 113 of the internal guide pipe 112, in which a screw head of the piston rod 130 is latched to a latching protrusion 141 and a male screw in a lower side of the piston rod 130 is screw-engaged with the screw fastening part 122.

According to another embodiment of the present invention, the cushioning member 200 includes a body 210 and 220 and is detachably fitted in the seating recess 20, the body includes a case 210 made of an elastic material and a cover 220 covering an opened upper part of the case 210, a spring 230 is fitted around a spring support unit 240 made of an elastic material and is received in an inner space 212 of the body 210 and 220 in a standing state while being vertically compressed, a second Velcro 222 is attached to an upper surface of the cushioning member 200 and is Velcro-attached with a first Velcro 21 of the seating recess 20, and the support plate 213 is attached to a lower surface of the cushioning member 200 and serves as a part to be in contact with a ground surface.

Advantageous Effects

Accordingly, the present invention has an advantage in that the cushioning member 100 and 200 is separately manufactured from a main body of the shoe and the cushioning member 100 and 200 is easily detachable from the heel 11 of the shoe through the attachment by the Velcros 21, 111, and 222, and it is possible to mount the cushioning member 100 and 200 only by forming the seating recess 20 having a simple structure at the heel 11, so that it is possible to simply change the already-established manufacturing equipment of the shoe and it is possible to easily manufacture the cushioning member 100 and 200 because of the simple structure of the cushioning member 100 and 200.

Further, the cushioning member 100 according to the present invention can be simply assembled or separated by the piston rod 130 so that it is possible to easily replace the spring 140 and the cushioning piece 150. Therefore, it is possible to simply and conveniently adjust the cushioning member 100 to have the desired cushioning degree appropriate for the weight of any person and the user can directly adjust the cushioning degree as well.

Further, the cushioning member 100 according to the present invention limits the maximum displacement of the spring 140 to make the spring 140 return to its original state through receiving the restoration force from the cushioning piece 150. Therefore, it is possible to use the spring 140 for a long time without the replacement and it is possible to easily replace the worn lower case 120 so that the repair expense of the cushioning member 100 can be advantageously reduced.

Furthermore, according to the cushioning member 100 of the present invention, the impact is absorbed by the spring 230, the case 210, and the cover 220 so that the impact can be relieved in multiple stages, the spring 230 is fitted around the spring support part 240 to extend the life-span of the spring 230, and the air of the inner space 212 is exhausted and the outside air is introduced to the inner space 212 so that it is possible to achieve the cushioning effect by the air flow. Therefore, if a problem is generated in one cushioning scheme, the cushioning function can be implemented by the remaining cushioning schemes so that it is possible to use the heel 30 for shock absorbing without the replacement of the heel 30.

BRIEF DESCRIPTION OF THE DRAWINGS

The above and other aspects, features and advantages of the present invention will be more apparent from the following detailed description taken in conjunction with the accompanying drawings, in which.

BEST MODE

[Mode for Invention]

Figure 1:
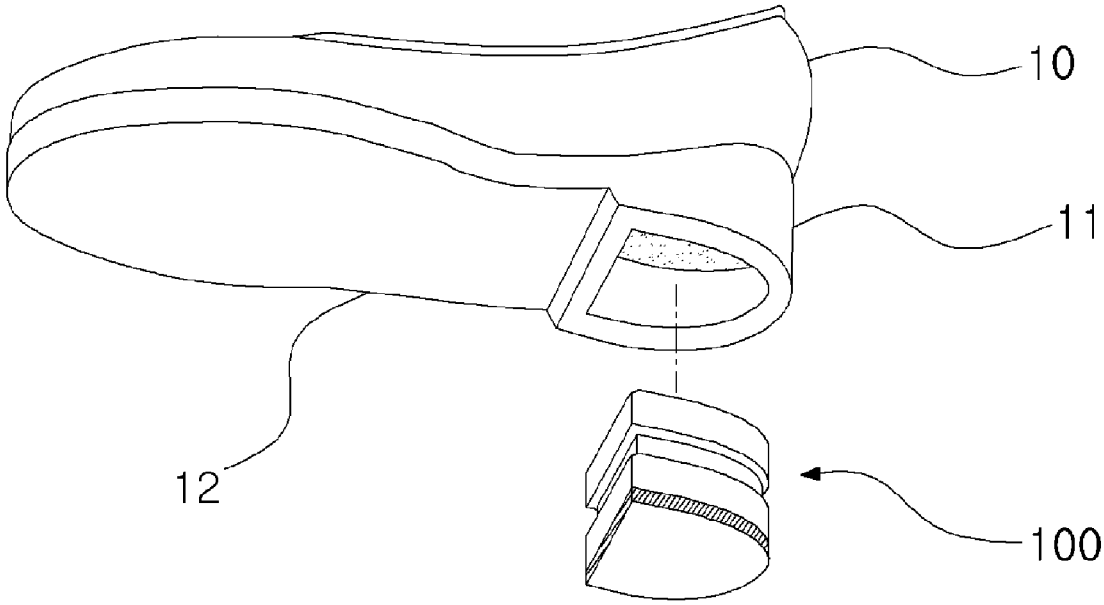
FIG. 1 is a perspective view illustrating a bottom surface of a shoe including a detachable cushioning member according to a first embodiment of the present invention.

Hereinafter, exemplary embodiments of the present invention will be described with reference to the accompanying drawings for easy implementation by those skilled in the art. In the following description, the same elements will be designated by the same reference numerals although they are shown in different drawings. Further, in the following description, detailed explanation of known related functions and constitutions may be omitted so as to avoid unnecessarily obscuring the subject manner of the present invention.

Figure 2:
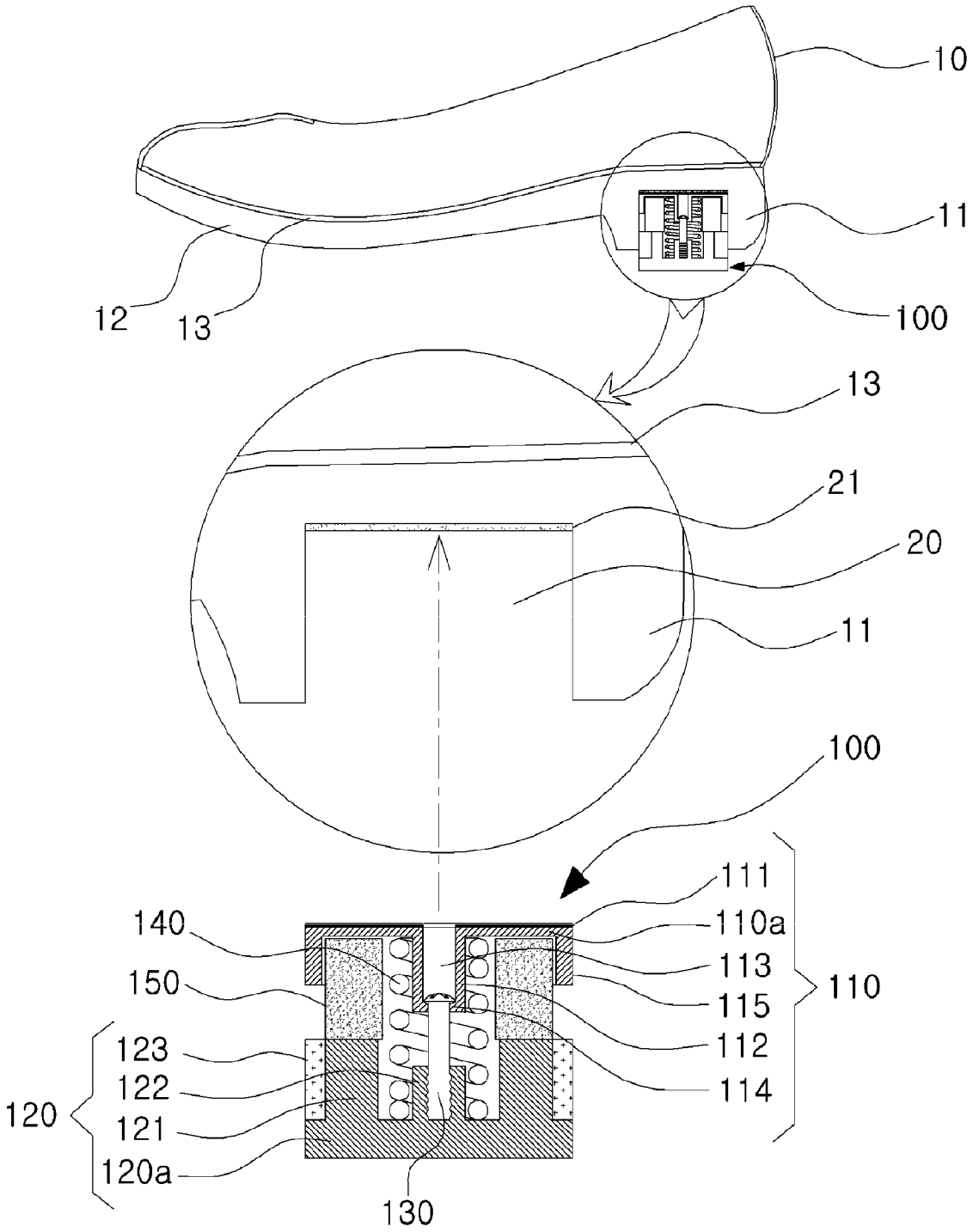
FIG. 2 is a cross-sectional view illustrating a shoe including a detachable cushioning member according to a first embodiment of the present invention and a partial enlarged view illustrating a state where the cushioning member 100 is mounted.
Figure 3:
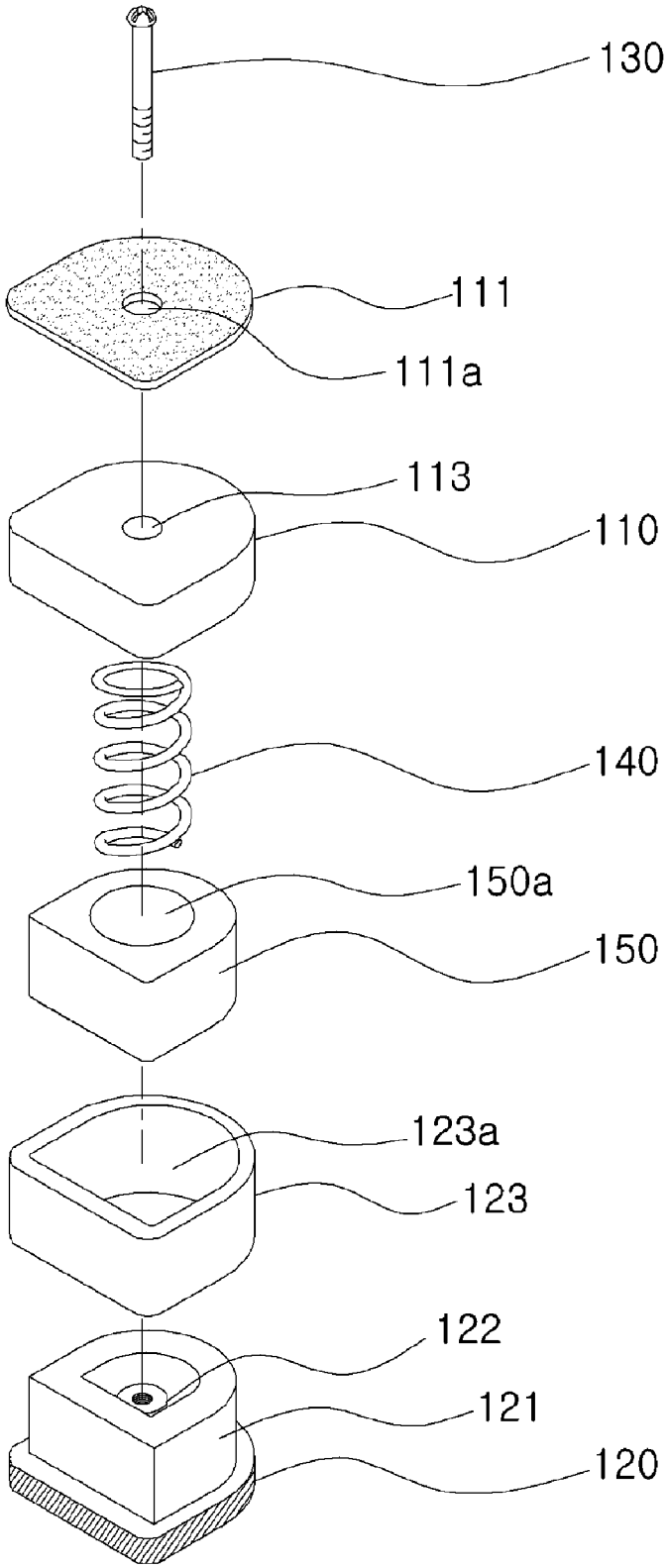
FIG. 3 is an exploded perspective view illustrating the detachable cushioning member 100 according to a first embodiment of the present invention.
Figure 4:
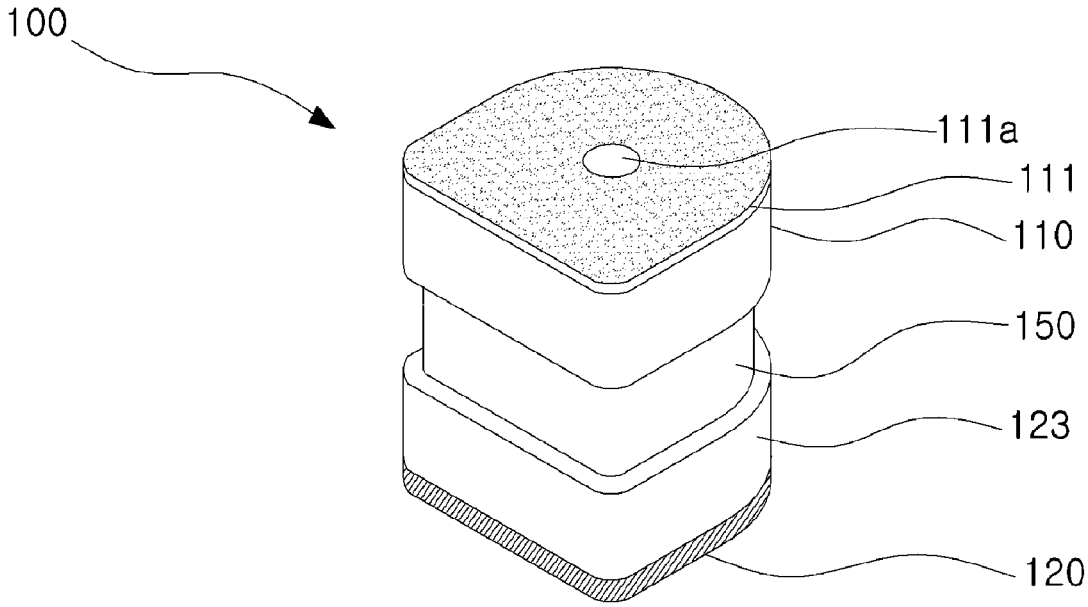
FIG. 4 is a perspective view illustrating an upper surface of the detachable cushioning member 100 according to a first embodiment of the present invention.

FIG. 1 is a perspective view illustrating a bottom surface of a shoe including a detachable cushioning member according to an embodiment of the present invention, FIG. 2 is a cross-sectional view illustrating a shoe including a detachable cushioning member according to an embodiment of the present invention and a partial enlarged view illustrating a state where the cushioning member 100 is mounted, FIG. 3 is an exploded perspective view illustrating the detachable cushioning member 100 according to an embodiment of the present invention, and FIG. 4 is a perspective view illustrating an upper surface of the detachable cushioning member 100 according to an embodiment of the present invention.

Referring to FIGS. 1 through 4, the shoe including the detachable cushioning member according an embodiment of the present invention employs a detachable cushioning member 100 instead of including an upper 10 attached or sealed to an upper part of an outsole 12 and an insole 13 attached to a bottom surface of an internal side of the upper 10 as in the conventional shoe. To this end, the present invention has the structure in which a seating recess 20 is formed at a heel 11 corresponding to a rear portion of the outsole 12 so that the cushioning member 100 is detachable from the seating recess 20. Herein, a lower side of the cushioning member 100 protrudes outward from the seating recess 20 in a state of the pressure being not applied and is fitted in the seating recess 20.

The seating recess 20 shaped like a depression is formed at a lower surface of the heel 11 and faces upward, and a first Velcro 21 is attached to an upper surface facing the insole 13 among the internal surfaces of the seating recess 20. Herein, it is preferred that the first Velcro 21 is formed with a hook-type Velcro and a second Velcro 111 to be described later is formed with a loop-type Velcro, between the hook-type Velcro and the loop-type Velcro. That is, the shoe including the seating recess 20 according to the present invention can be used without mounting the cushioning member 100 to be described later and in this case, foreign materials, such as dust, may be in contact with the first Velcro 21. In this respect, in order to prevent the foreign materials from adhering to the first Velcro 21 if the foreign materials are in contact with the first Velcro 21 or to make the foreign materials be easily separated from the first Velcro 21 even if the foreign materials adhere to the first Velcro 21, the first Velcro 21 is preferably formed with the hook-type Velcro. In the meantime, the first Velcro 21 is sewn on the heel 11 when it is attached to the seating recess 20 so that the first Velcro 21 can be more solidly fixed to the seating recess 20.

The cushioning member 100 includes a body and the body includes an upper case 110 and a lower case 120. A spring 140 and a cushioning piece 150 are disposed between the upper case 110 and the lower case 120, and in this state the cushioning member 100 is bolt-assembled by a piston rod 130 having a bolt shape.

The upper case 110 includes the body 110*a* shaped like a plate, the second Velcro 111 having a through hole 111*a* is attached to an upper surface of the upper case 110, guide pipes 112 and 115 having a pipe shape are provided at an internal side and an external side of a lower surface of the upper case 110, respectively, and a hollow hole 113 of the internal guide pipe 112 is connected with the through hole 111*a* of the second Velcro 111. Herein, the external guide pipe 115 protrudes downward along a contour of the body 110*a*. Therefore, in the whole view, the internal guide pipe 112 and the external guide pipe 115 are concentrically arranged within the external guide pipe 115, and a band-shaped upper part interconnects upper ends of the internal guide pipe 112 and the external guide pipe 115, thereby closing the upper side of the space between them. Further, the second Velcro 111 is attached to the upper surface of the upper case 110 so that the second Velcro 111 is Velcro-assembled with the first Velcro 21 attached to the seating recess 20. The inside hollow hole 113 of the internal guide pipe 112 includes a latching protrusion 114 having a step jaw so as to decrease a diameter of the lower side of the internal guide pipe 112 so that a screw head of the piston rod 130 is latched to the latching protrusion 114 when the piston rod 130 to be described later is fitted in the hollow hole 113 of the internal guide pipe 112.

The lower case 120 includes a body 120*a* shaped like a plate to be corresponding to a size of the contour of the upper case 110 and is disposed in the lower side of the upper case 110 to be assembled with the upper case 110. The lower case 120 includes a support pipe 121 shaped like a pipe, which is formed at an upper surface of a position corresponding to the space between the internal guide pipe 112 and the external guide pipe 115 and protrudes in an upper direction. Further, the lower case includes a screw fastening part 122 shaped like a protrusion, which includes a female screw and is formed at an upper surface of a position corresponding to the internal guide pipe 112.

Therefore, as seen in a whole view of the lower case 120, the support pipe 121 protrudes in an inner side of the contour of the body 120*a* and the screw fastening part 122 protrudes in an inner side of the support pipe 121. If the upper case 110 is pressed and moves toward the lower case 120, the upper surface of the screw fastening part 122 is in contact with the lower surface of the internal guide pipe 112 and the upper surface of the support pipe 121 faces the space between the internal guide pipe 112 and the external guide pipe 115. At this time, the diameter of the inner side of the support pipe 121 is larger than that of the external side of the internal guide pipe 112 so that a space is provided so as for the spring 140 to be fitted around the internal guide pipe 112 and the screw fastening part 122.

Further, the screw fastening part 122 includes a recess formed downward from the upper surface of the screw fastening part 122 and a female screw formed in the recess, so that the female screw of the screw fastening part 122 is screw-engaged with a male screw formed at the lower side of the piston rod 130 to be described later.

In the meantime, a reinforcement 123 fitted around the support pipe 121 is formed at the upper surface of the lower case 120 that corresponds to a position of the external guide pipe 115 in the upper surface of the lower case 120. At this time, the reinforcement 123 includes a vertically extending hollow hole 123*a*, is formed to be appropriate for the contour of the body 120*a* of the lower case 120, and is forcedly fitted around the support pipe 121, and the height of the reinforcement 123 corresponds to that of the support pipe 121. Therefore, if the upper case 110 is pressed and moves toward the lower case 120, an upper surface of the reinforcement 123 is in contact with the lower surface of the external guide pipe 115 of the upper case 110. Here, the lower case 120 is a part that is in contact with the ground surface and is made of a rubber material that is a material for the support plate adopted for general shoes or high-heeled shoes. In this respect, the reinforcement 123 is made of a material of rigid plastic or metal for reinforcing the support plate 213.

The spring 140 is fitted around an outer wall of the internal guide pipe 112 and an outer wall of the screw fastening part 122 so that the lower surface of the upper case 110 is elastically supported against the upper surface of the lower case 120. That is, the upper part of the spring 140 is fitted around the internal guide pipe 112 and the lower part of the spring 140 is fitted around the screw fastening part 122, and the spring 140 includes a compression-type spring.

The cushioning piece 150 is made of elastic materials, such as silicon, urethane, or foamable rubber. The cushioning piece 150 has a hollow hole 150*a* vertically extending through a central part of the cushioning piece 150 and is fitted between the internal guide pipe 112 and the external guide pipe 115, while allowing the upper side of the spring 140 to be seated in the hollow hole 150*a* of the cushioning piece 150, so that the lower surface of the upper case 110 is elastically supported against the upper surface of the support pipe 121. That is, the support pipe 121 is disposed under the cushioning piece 150 so that the cushioning piece 150 is supported by the support pipe 121 and elastically supports the upper case 110.

The piston rod 130 is shaped like a bolt, in which a screw head is formed at the upper side and a male screw is formed at the lower side of the piston rod 130. The spring 140 and the cushioning piece 150 are disposed between the upper case 110 and the lower case 120, the piston rod 130 is fitted in the hollow hole 113 of the internal guide pipe 112 in a state in which the male screw is oriented downward, so that the screw head is latched to the latching protrusion 114 and the male screw formed at the lower side of the piston rod 130 is screw-engaged with the screw fastening part 122. Further, instead of the piston rod 130, it is possible to employ a general bolt in which a screw is partially formed at the lower side of the piston rod 130.

When the user wears the shoes after the cushioning member 100 assembled though fastening the piston rod 130 is fitted in the seating recess 20 of the heel 11, pressure is applied to the upper case 110. At this time, the upper case 110 is pressed downward while receiving elastic force by the spring 140 and the cushioning piece 150 so that the screw head of the piston rod 130 is guided by the hollow hole 113 of the internal guide pipe 112 to move in an upper direction. If the pressure applied to the upper case 110 is released, the upper case 110 upward moves by the spring 140 and the cushioning piece 150, so that the screw head of the piston rod 130 is guided by the hollow hole 113 and moves toward the latching protrusion 114 in the lower side of the hollow hole 113.

The cushioning member 100 constructed as such is assembled in a manner that the spring 140 and the cushioning piece 150 are fitted in the upper case 110 and the lower case 120 to be disposed between the upper case 110 and the lower case 120 and the upper case 110 is screw-engaged with the lower case 120 by the piston rod 130. Therefore, the assembling process is simple and the user can directly replace only the worn lower case 120 as well, so that it is possible to reduce the repair expense of the cushioning member 100. That is, the user can separately purchase only the lower case 120 and repair the lower case 120 by him/herself.

Further, it is easy to replace the lower case 120 so that it is possible to purchase the lower cases 120 having different heights and then select and assemble the lower case 120 having the desired height, thereby enabling the user to change the height of the heel of the shoe to the desired height at any time.

Further, the spring 140 and the cushioning piece 150 are replaced so as to adjust the cushioning degree and the replacement process is simple and easy, so that the user can easily change the cushioning degree to the desired cushioning degree. In general, the cushioning degree by the shock-absorbing is differently desired by each person, as well as weight is different for an individual. In this respect, according to the present invention, it is possible to simply replace the spring 140 and the cushioning piece 150 so that the user can adjust the cushioning degree to the desired cushioning degree.

Further, the cushioning member 100 according to the present invention limits the maximum compression displacement of the spring 140 up to the internal guide pipe 112 and the screw fastening part 122 so that the cushioning member 100 can prevent the spring 140 from displacing over the limited displacement and losing elastic restoration force. Further, restoration force of the cushioning piece 150 is applied to the spring 140 during the restoration of the spring 140 into an original state so that the spring 140 easily returns to the original state. Therefore, if the user uses the cushioning member 100 of the present invention for a long time, it is possible to maintain the elastic property of the spring 140.

Figure 5:
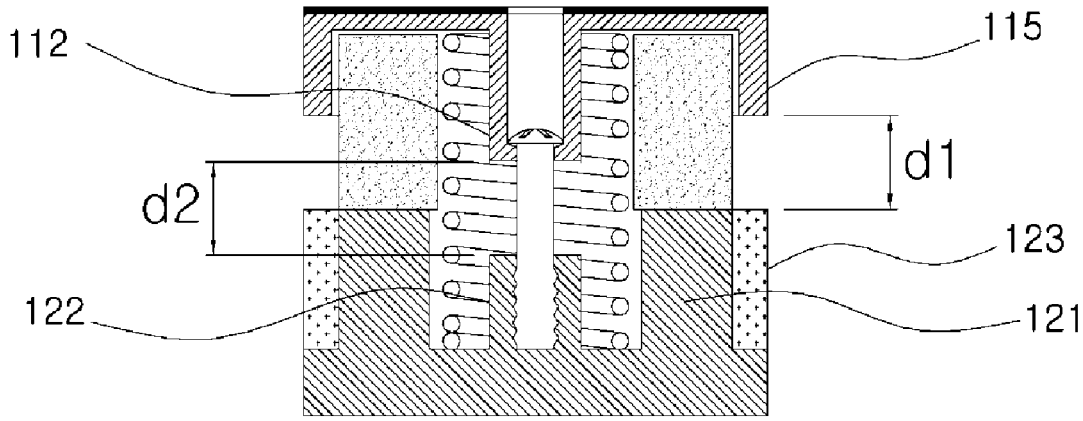
FIG. 5 is a cross-sectional view illustrating the detachable cushioning member 100 according to a first embodiment of the present invention.

FIG. 5 is a cross-sectional view illustrating the detachable cushioning member 100 according to the embodiment of the present invention.

According to the embodiment of the present invention, a distance d2 between the internal guide pipe 112 and the screw fastening part 122 is identical to a distance d1 between the external guide pipe 115 and the reinforcement 123. That is, if pressure applied to the upper case 110 increases so that the internal guide pipe 112 is in contact with the screw fastening part 122, the external guide pipe 115 is in contact with the reinforcement 123 at the same time so that load is distributed to the screw fastening part 122 and the reinforcement 123. Therefore, the internal guide pipe 112 and the screw fastening part 122 are not damaged even if the large pressure is applied to the upper case 110.

Figure 6:
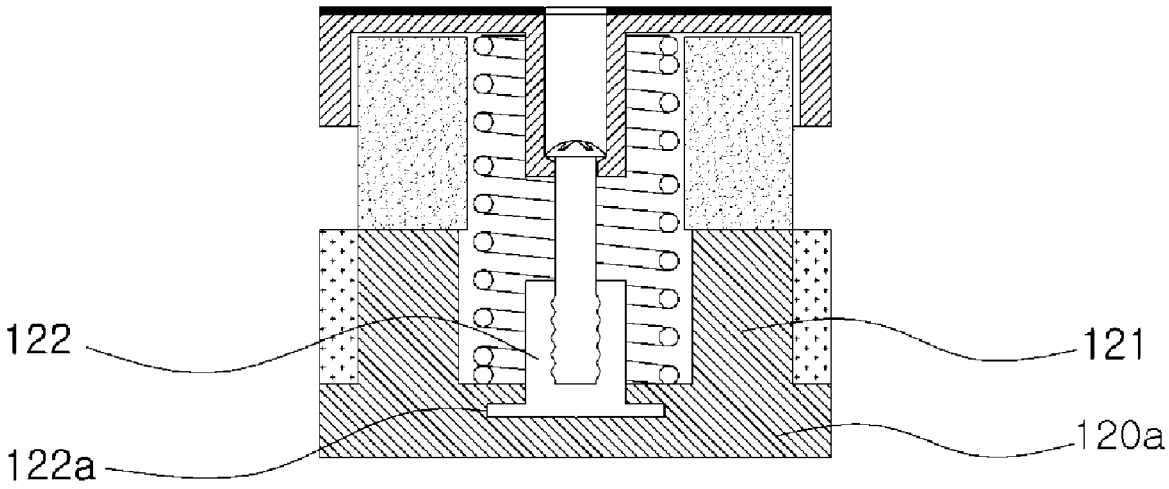
FIG. 6 is a cross-sectional view illustrating another shape of the detachable cushioning member 100 according to a first embodiment of the present invention.

FIG. 6 is a cross-sectional view illustrating another shape of the detachable cushioning member 100 according to the embodiment of the present invention.

Referring to FIG. 6, the screw fastening part 122 includes a flange 122*a* at a rim of a lower end of the screw fastening part 122 and the flange 122*a* is embedded in the inner side of the lower case 120. That is, the lower case 120, which is a part being in contact with the ground surface, is made of a material, such as rubber, etc. However, the screw fastening part 122 is screw-engaged with the piston rod 130 so that it is preferred that the screw fastening part 122 is made of a metallic material to be strongly engaged with the piston rod 130. Therefore, the screw fastening part 122 is made of the material stronger than that of the lower case 120 and is fixed to the lower case 120.

Figure 7:
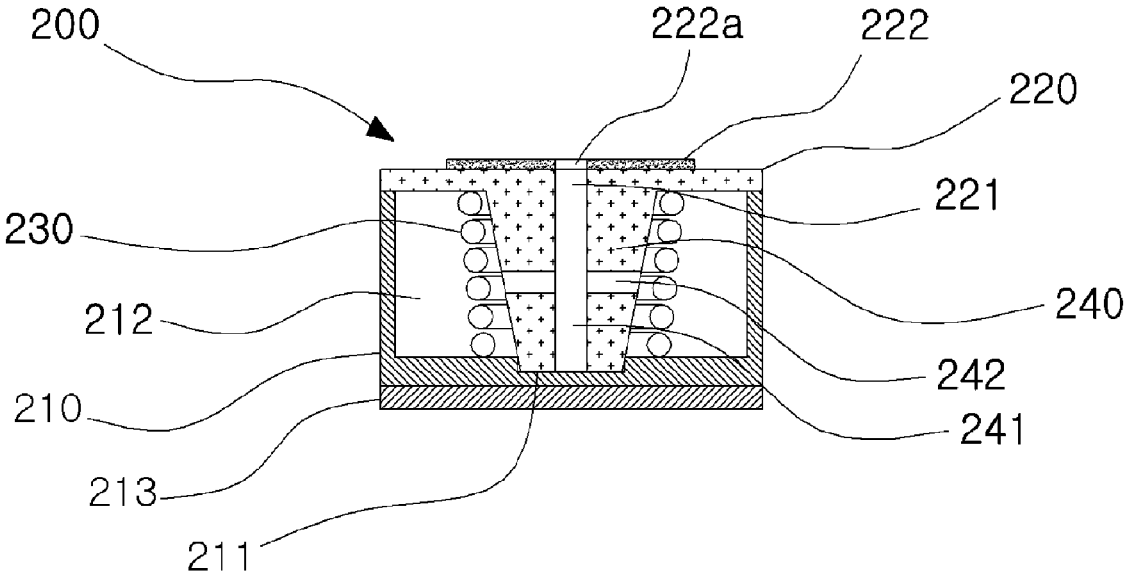
FIG. 7 is a cross-sectional view illustrating a side of a shoe including a detachable cushioning member according to a second embodiment of the present invention.
Figure 8:
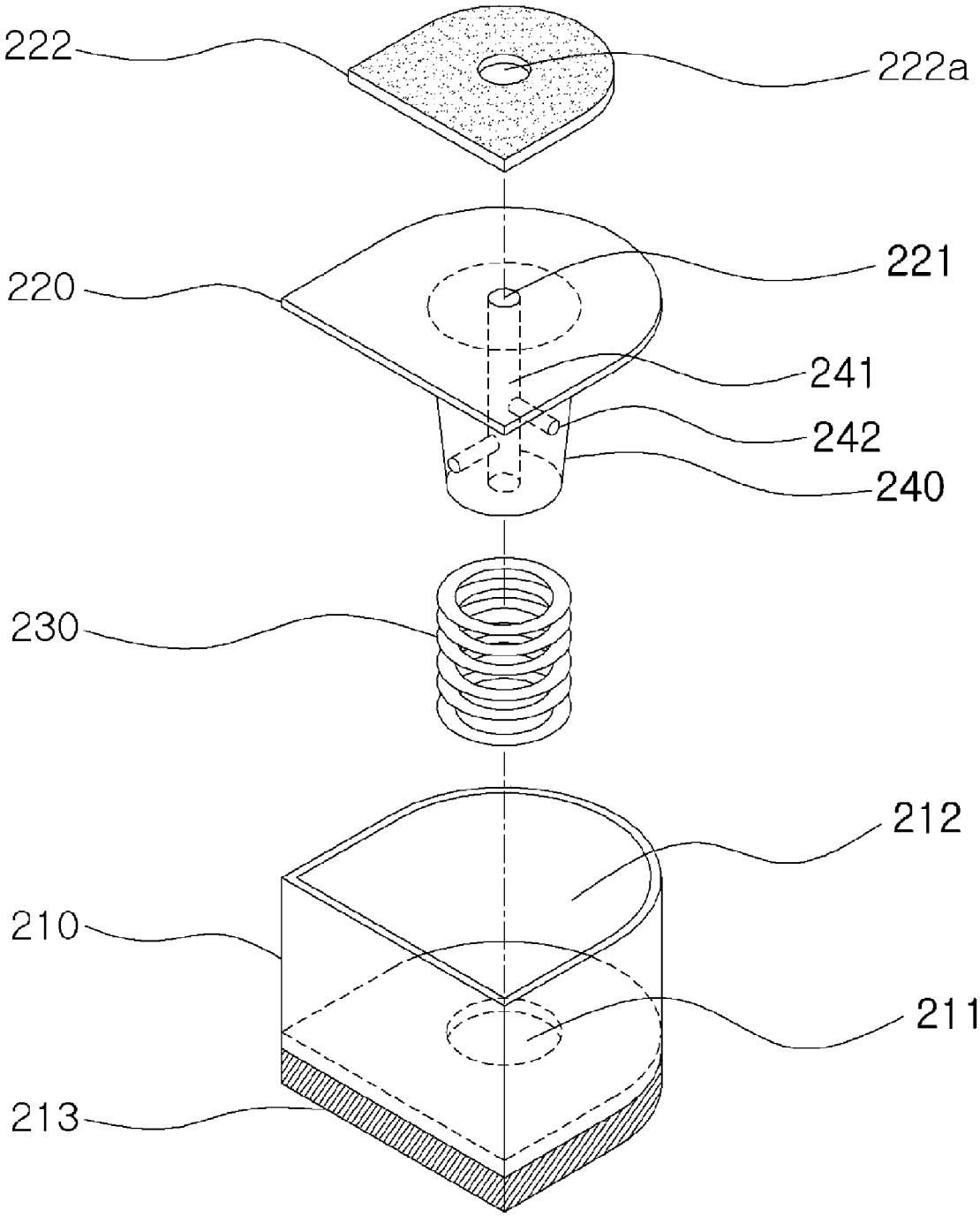
FIG. 8 is an exploded perspective view illustrating a cushioning member 200 according to a second embodiment of the present invention.
Figure 9:
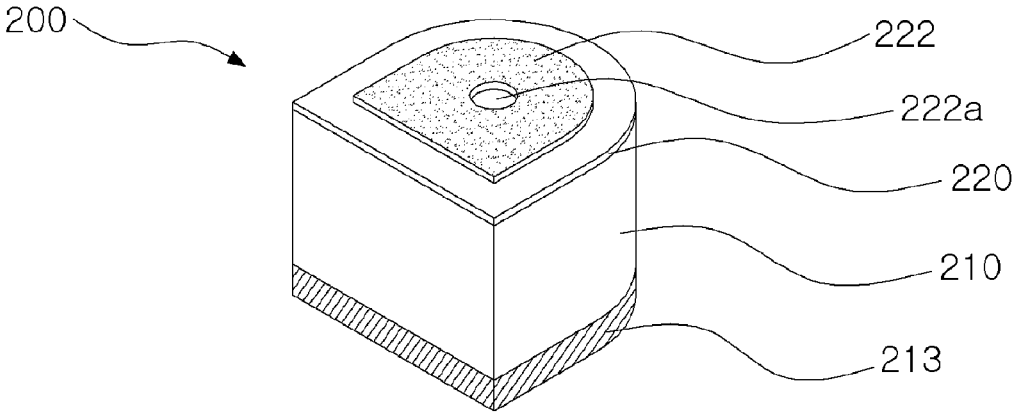
FIG. 9 is a perspective view illustrating an upper surface of the cushioning member 200 according to a second embodiment of the present invention.

FIG. 7 is a cross-sectional view illustrating a side of the shoe including the detachable cushioning member according to a second embodiment of the present invention, FIG. 8 is an exploded perspective view illustrating the cushioning member 200 according to the embodiment of the present invention, and FIG. 9 is a perspective view illustrating an upper surface of the detachable cushioning member 200 according to the second embodiment of the present invention.

The cushioning member 200 illustrated in FIGS. 7 through 9 is made of an elastic material, such as rubber. The cushioning member 200 has a case 210 having an opened upper part and a cover 220 for covering the opened upper part of the case 210, in which the case 210 and the cover 220 form a body 210 and 220. The body 210 and 220 has an inner space 212 in an inside of the body 210 and 220, a second Velcro 222 to be Velcro-attached to the first Velcro 21 attached to the seating recess 20 is attached to an upper surface of the cover 220 that corresponds to the upper surface of the cushioning member 200, and a support plate 213 that is in contract with the ground surface is attached to a lower surface of the case 210 that corresponds to the lower surface of the cushioning member 200. In the present embodiment of the present invention, the cover 220 is attached to an upper end of the case 210 by adhesives, the second Velcro 222 is attached to the upper surface of the cover 220 by adhesives, and the support plate 213 is attached to the lower surface of the external side of the case 210 by adhesives.

Further, a spring 230 fitted around a spring support part 240 that is made of the elastic material is received in the inner space 212 of the cushioning member 200. The spring 230 includes a compression spring, and the spring support part 240 is inserted in the spring 230 while being in tight contact with an inside of the spring 230. The spring support part 240 is received in the inner space 212 in a standing state, so that the elastic force of the spring 230 can be applied in an upward direction in response to the vertical compression of the spring 230. In the present embodiment of the present invention, the spring support part 240 has a cylindrical shape and protrudes downward from the lower surface of the cover 220. Further, the opened upper part of the case 210 is closed by the cover 220, and the spring support part 240, which protrudes from the lower surface of the cover 220 and around which the spring 230 is fitted, is received in the inner space 212.

It is preferred that the case 210, the cover 220, and the spring support part 240 are made of the same elastic material, and they are made of rubber in the present embodiment of the present invention.

If the cushioning member 200 constructed as such is inserted in the seating recess 20, the impact transferred from the support plate 213 can be cushioned with elastic force of the spring 230, the spring support part 240, the case 210, and the cover 220. Further, the spring support part 240 supports the spring 230 so that the restoration force of the spring support part 240 during the release of compression force is applied to the spring 230, thereby aiding the spring 230 to restore into the original state. In general, if the compression and the compression release of the spring are repeated, the restoration force of the spring is reduced by elastic fatigue and if the compression force is released, the spring does not return to the original state. However, according to the present invention, the spring support part 240 supports the spring 230 so that it is possible to maintain the restoration force of the spring 230.

Further, according to the present invention, the upper part of the spring 230 is in contact with the lower surface of the cover 220 and the lower part of the spring 230 is in contact with the lower surface of the case 210, so that it is possible to achieve the multistage cushioning property provided by the sequential structure including the cover 220, the spring 230, and the lower part of the case 210. In the present invention, in order to provide the cushioning effect to the heel, a spring having a large modulus of elasticity capable of resisting even a great impact is mounted. Therefore, the heel is elastically supported by the elastic force of the cover 220 and the case 210 at the moment of application of an initial impact, and is then elastically supported by the elastic force of the spring 230 if a larger impact is continued, so that the initial impact can be relieved by the cover 220 and the case 210 that have the small elastic force, which can smoothly relieve the impact.

In the process of the cushioning work with respect to the initial impact, the lower surface of the case 210 is compressed against the cover 220, and at this time, the lower part of the spring 230 is dug into the lower surface of the case 210 as if it is buried in the lower surface of the case 210 and the upper part of the spring 230 is dug into the lower surface of the cover 220 as if it is buried in the lower surface of the cover 220. Therefore, if the initial impact is small, the initial impact is cushioned by the elastic force of the case 210 and the cover 220. Next, as the impact increases, the spring 230 is compressed and the spring support part 240 is compressed together with the spring 230 at the same time, so that the increased impact is cushioned by the elastic force of the spring 230 and the spring support part 240.

In the meantime, the spring support part 240 includes a hole 241 vertically extending through a center of a sectional surface of the spring support part 240 and a side hole 242 in a lateral side of the spring support part 240 by which the inner space 212 of the case 210 is connected with the hole 241

Further, the second Velcro 222 includes a vertically extending through hole 222*a* at a center of the second Velcro 222 and the cover 220 of the case 210 to which the second Velcro 222 is attached includes an air hole 221 that is connected with the hole 241 and the through hole 222*a* of the second Velcro 222 at a center of the cover 220.

As described above, if the cushioning member 200 having the hole 241, the air hole 221, and the through hole 222*a* is compressed and deformed by the pressure applied after being mounted to the seating recess 20, the air of the inner space 212 moves toward the first and second Velcros 21 and 222 through the hole 241, the air hole 221, and the through hole 222*a*. Then, after passing a gap between the first and second Velcros 21 and 222, the air is exhausted to the outside through a gap between an external wall surface of the case 210 and an internal wall surface of the seating recess 20. Here, the air of the inner space 212 is not exhausted all at once during the exhaustion of the air to the outside, but the air of the inner space 212 is gradually exhausted according to the flow route as described above, so that the cushioning effect by the air can be achieved.

Further, if the pressure applied to the cushioning member 200 is released, the case returns to the state prior to compressing by the elastic restoration force of the spring 230, the spring support part 240, and the case 210 so that the outside air is introduced to the inner space 212. Further, the first Velcro 21 and the second Velcro 222 can restrain the air from being rapidly exhausted during the exhaustion of the air of the inner space 212 or the introduction of the outside air to the inner space 212. That is, the hook-type Velcro of the first Velcro 21 and the loop-type Velcro of the second Velcro 222 create a gap through which the air passes between the hooks and the loops. Therefore, if the first Velcro 21 is Velcro-attached to the second Velcro 222, it is possible to restrain the air from rapidly flowing during the passing of the air through the gap.

Meanwhile, it is not shown in the drawings, however a vertically extending long recess (not shown) is formed at a side wall of the case 210, so that the air flowing through the gap between the seating recess 20 and the cushioning member 200 can be smoothly passed through the long recess (not shown).

Further, in the cushioning member 200, the spring support part 240 around which the spring 230 is fitted is not inclined in a right and left side.

That is, the recess 211 is formed at the lower surface of the inside of the case 210 for fitting the lower part of the spring support part 240 so that the lower part of the spring support part 240 is fitted in the recess 211 when the spring support part 240 is received in the inner space 212. At this time, the lower surface of the spring support part 240 can be attached to a bottom surface of the recess 211 by adhesives.

Figure 10:
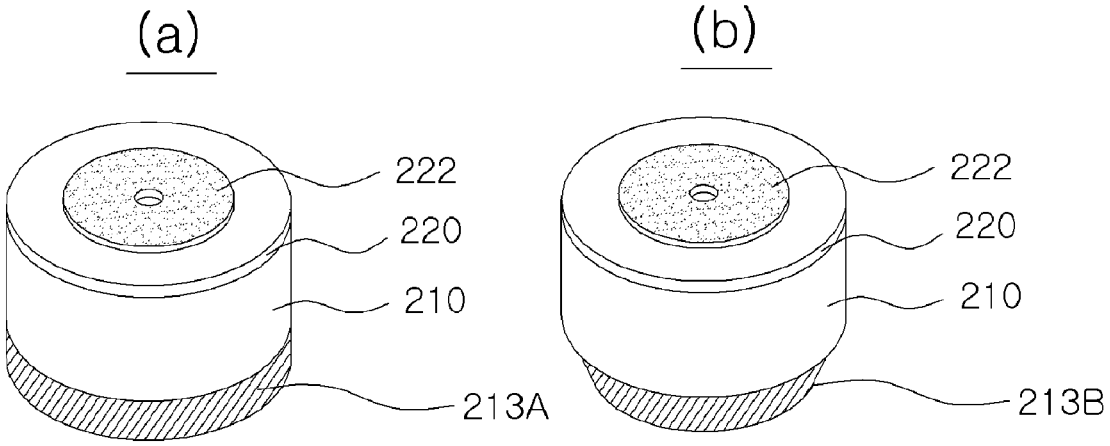
FIGS. 10A and 10B are perspective views illustrating various shapes of an upper surface of a support plate 213 of the cushioning member 200 according to an embodiment of the present invention.

FIGS. 10A and 10B are perspective views illustrating various shapes of the upper surface of the support plate 213 of the cushioning member 200 according to the embodiment of the present invention.

The cushioning member 200 shown in FIG. 10A includes the body 210 and 220 having a cylindrical shape, in which the body 210 and 220 has the case 210 and the cover 220, and the support plate 213A having a cylindrical shape. The cushioning member 200 shown in FIG. 10B has the support plate 213B of which the diameter of the plane surface decreases in a down direction in the cushioning heel of FIG. 10A. As described above, the cushioning member 200 of the shoes for cushioning the impact according to the present invention has various shapes of the case 210, the cover 220, and the support plates 213A and 213B and the seating recess 20 corresponding to the various shapes is formed in the shoes.

The foregoing is merely an exemplary embodiment of the technical sprit of the present invention and it will be readily understood by those skilled in the art that various modifications and changes can be made thereto within the technical spirit and scope of the present invention. Thus, the exemplary embodiment disclosed in the present invention is not for limiting the technical sprit, but for describing it, and the present invention is not limited thereto. The protection scope of the present invention shall be interpreted by the appended claims and every technical sprit within its equivalent scope shall be understood to be included in the claims of the present invention.

The invention claimed is:

1. A shoe comprising a detachable cushioning member, in which the cushioning member is detachable from a heel of the shoe, comprising:

a seating formed at a lower surface of the heel, the seating recess comprising a first hook and loop fastener attached to a top interior surface; and a cushioning member fitted in the seating recess, of which a lower side protrudes from the heel, in which the cushioning member comprises:

an upper case comprising a second hook and loop fastener having a through hole in an upper surface of the upper case, an internal guide pipe and an external guide pipe formed at an internal side and an external side of a lower surface of the upper case, respectively, and a latching protrusion by which a diameter of a lower end of a hollow hole is reduced, the hollow hole of the internal guide pipe being connected with a through hole of the second hook and loop fastener;

a lower case having a size appropriate for a size of a contour of the upper case, the lower case comprising a support pipe at an upper surface of a position that corresponds to a space between the internal guide pipe and the external guide pipe and a screw fastening part having a protrusion shape and including a female screw, the screw fastening part being positioned in an upper surface of a position that corresponds to the internal guide pipe;

a spring fitted around the internal guide pipe and the screw fastening part to elastically support a lower surface of the upper case against an upper surface of the lower case;

a cushioning piece fitted between the internal guide pipe and the external guide pipe in a state in which the cushioning piece is fitted around an upper part of the spring to elastically support a lower surface of the upper case against an upper surface of the support pipe; and a piston rod fitted in the hollow hole of the internal guide pipe, in which a screw head of the piston rod is latched to a latching protrusion and a male screw in a lower side of the piston rod is screw-engaged with the screw fastening part.

2. The shoe as claimed in claim 1, wherein a reinforcement is fitted around the support pipe and is formed at an upper surface of the lower case that corresponds to a position of the external guide pipe among the upper surface of the lower case, and a distance between the internal guide pipe and the screw fastening part is identical to a distance between the external guide pipe and the reinforcement.

3. The shoe as claimed in claim 2, wherein the screw fastening part comprises a flange at a rim of a lower end of the screw fastening part and the flange is buried in an inside of the lower case.

4. A shoe comprising a detachable cushioning member, in which the cushioning member is detachable from a heel of the shoe, comprising:

a seating recess formed at a lower surface of the heel, the seating recess comprising a first hook and loop fastener attached to a top interior surface; and a cushioning member fitted in the seating recess, of which a lower side protrudes from the heel, wherein the cushioning member comprises a body and is detachably fitted in the seating recess, the body comprises a case made of an elastic material and a cover covering an opened upper part of the case, a spring is fitted around a spring support unit made of an elastic material and is received in an inner space of the body in a standing state while being vertically compressed, a second hook and loop fastener is attached to an upper surface of the cushioning member and is hook and loop fastener attached with a first hook and loop fastener of the seating recess, and the support plate is attached to a lower surface of the cushioning member and serves as a part to be in contact with a ground surface.

5. The shoe as claimed in claim 4, wherein the spring support part comprises a vertically extending hole and a side hole at a side of the spring support part by which an inner space of the cushioning member is connected with the hole, and the second hook and loop fastener and the cover of the case to which the second hook and loop fastener is attached is attached includes air holes that are connected with the hole, so that the inner space is connected with an external side via a gap between an internal surface of the seating recess and an external surface of the cushioning member.

6. The shoe as claimed in claim 5, wherein the first hook and loop fastener includes hooks and the second Velcro hook and loop fastener includes loops.

* * * * *